US009554208B1

(12) United States Patent
Jain et al.

(10) Patent No.: US 9,554,208 B1
(45) Date of Patent: Jan. 24, 2017

(54) CONCURRENT SOUND SOURCE LOCALIZATION OF MULTIPLE SPEAKERS

(71) Applicant: Marvell International Ltd., Hamilton (BM)

(72) Inventors: Kapil Jain, Santa Clara, CA (US); Zining Wu, Los Altos, CA (US)

(73) Assignee: Marvell International Ltd., Hamilton (BM)

( * ) Notice: Subject to any disclaimer, the term of this patent is extended or adjusted under 35 U.S.C. 154(b) by 0 days.

(21) Appl. No.: 14/657,479

(22) Filed: Mar. 13, 2015

Related U.S. Application Data

(60) Provisional application No. 61/972,213, filed on Mar. 28, 2014.

(51) Int. Cl.
*H04R 1/40* (2006.01)
*G10L 21/0216* (2013.01)

(52) U.S. Cl.
CPC ..... *H04R 1/406* (2013.01); *G10L 2021/02166* (2013.01)

(58) Field of Classification Search
None
See application file for complete search history.

(56) References Cited

U.S. PATENT DOCUMENTS 6,339,758 B1 * 1/2002 Kanazawa ..... G10L 21/02 381/94.3
2002/0138254 A1 * 9/2002 Isaka ..... G10L 21/02 704/208

* cited by examiner

*Primary Examiner* — Mark Fischer

(57) ABSTRACT

In aspects of concurrent sound source localization of multiple speakers, audio signals from two or more microphones are upsampled, and then the upsampled audio signals are time-multiplexed to a plurality of beamformers. A first sound source received at the two or more microphones is localized at a first beamformer, and a second sound source received at the two or more microphones is localized at a second beamformer, where localizing the second sound source is constrained by the localization of the first sound source. The beamformers can filter the upsampled audio signals using beamformer coefficients from the localizations to produce beamformed audio signals.

20 Claims, 8 Drawing Sheets

CONCURRENT SOUND SOURCE LOCALIZATION OF MULTIPLE SPEAKERS

RELATED APPLICATION

This application claims priority to U.S. Provisional Patent Application Ser. No. 61/972,213 filed Mar. 28, 2014 entitled "Method for Concurrent Sound Source Localization of Multiple Speakers" to Jain et al., the disclosure of which is incorporated by reference herein in its entirety.

BACKGROUND

The Background described in this section is included merely to present a general context of the disclosure. The Background description is not prior art to the claims in this application, and is not admitted to be prior art by inclusion in this section.

Sound source localization techniques improve the quality of communications and reduce noise by directing microphones toward a desired sound source and/or away from an undesired sound or noise source. In order to localize multiple sound sources, such as with a conferencing system for multiple participants, microphone arrays with many microphones are used to localize multiple sound sources. However, as mobile computing and communication devices, such as mobile phones, tablet devices, notebook computers, and other network-connected devices are miniaturized, it is both space and cost prohibitive to include a microphone array for the localization of multiple sound sources in the smaller-sized devices.

Sound source localization techniques are described to improve the quality of communications and reduce noise by directing microphones toward a desired sound source and/or away from an undesired sound or noise source. The number of sound sources that can be concurrently localized and/or tracked depends on the number of microphones that are used. For example, a single sound source can be tracked concurrently with two microphones and two sound sources can be tracked concurrently with three microphones. For each additional microphone added, an additional sound source can be concurrently localized.

Concurrently localizing multiple sound sources is useful in various applications. For example, localizing sound sources can be used for reducing background noise when using a communications device, eliminating beamforming time delays during transitions between active speakers in a conference call, and canceling out the effects of echoes and/or reverberation in the environment around a communication device.

Conventional techniques for sound source localization employ microphone arrays with a number of microphones in each array to increase the number of sound sources that can be localized simultaneously. However, as mobile computing and communication devices, such as mobile phones, tablet devices, notebook computers, and other network-connected devices are miniaturized, it is both space and cost prohibitive to include a microphone array for the localization of multiple sound sources in the smaller-sized devices. Typically, a mobile phone may include three or fewer microphones, where one microphone is used to receive desired sound and the other microphones are used for noise cancellation.

SUMMARY

This Summary introduces concepts of concurrent sound source localization of multiple speakers, and the concepts are further described below in the Detailed Description and/or shown in the Figures. Accordingly, this Summary should not be considered to describe essential features nor used to limit the scope of the claimed subject matter.

In one aspect of concurrent sound source localization of multiple speakers, a method is described for upsampling audio signals from two or more microphones, then time-multiplexing the upsampled audio signals to a plurality of beamformers. The method also includes localizing, at a first beamformer of the plurality of beamformers, a first sound source received at the two or more microphones, and localizing, at a second beamformer of the plurality of beamformers, a second sound source received at the two or more microphones, where localizing the second sound source is constrained by the localization of the first sound source.

A device for concurrent sound source localization of multiple speakers includes an upsampler to upsample audio signals received from two or more microphones, and includes a time-multiplexer to distribute the upsampled audio signals to a plurality of beamformers. A first beamformer is configured to localize a first sound source received at the two or more microphones, and a second beamformer is configured to localize a second sound source received at the two or more microphones, where the localization of the second sound source is constrained by the localization of the first sound source.

A sound source localization system for concurrent sound source localization of multiple speakers includes an interface to receive signals of sound sources from two or more microphones, as well as two or more samplers to sample the received signals from the two or more microphones and produce corresponding sampled audio signals. The sound source localization system also includes a sound source localization manager that is configured to upsample the sampled audio signals and time-multiplex the upsampled audio signals to a plurality of beamformers. The sound source localization manager is also configured to localize, at a first beamformer, a first sound source received at the two or more microphones, and localize, at a second beamformer, a second sound source received at the two or more microphones, where the localization of the second sound source is constrained by the localization of the first sound source.

BRIEF DESCRIPTION OF THE DRAWINGS

Details of concurrent sound source localization of multiple speakers are described with reference to the following Figures. The same numbers may be used throughout to reference like features and components that are shown in the Figures.

DETAILED DESCRIPTION

Aspects of concurrent sound source localization of multiple speakers can use two microphones to concurrently localize multiple sound sources by upsampling audio signals from the two microphones. A multiple of the sample rate for the upsampling, over an initial sample rate for sampling the sounds received at the microphones, identifies the number of sound sources that are concurrently localized. By way of example and not limitation, a four-times upsampling enables four sound sources to be concurrently localized. Additionally, the aspects of concurrent sound source localization of multiple speakers may be used with more than two microphones.

While features and concepts of concurrent sound source localization of multiple speakers can be implemented in any number of different devices, systems, environments, and/or configurations, aspects of concurrent sound source localization of multiple speakers are described in the context of the following example environments, devices, systems, and methods.

Figure 1:
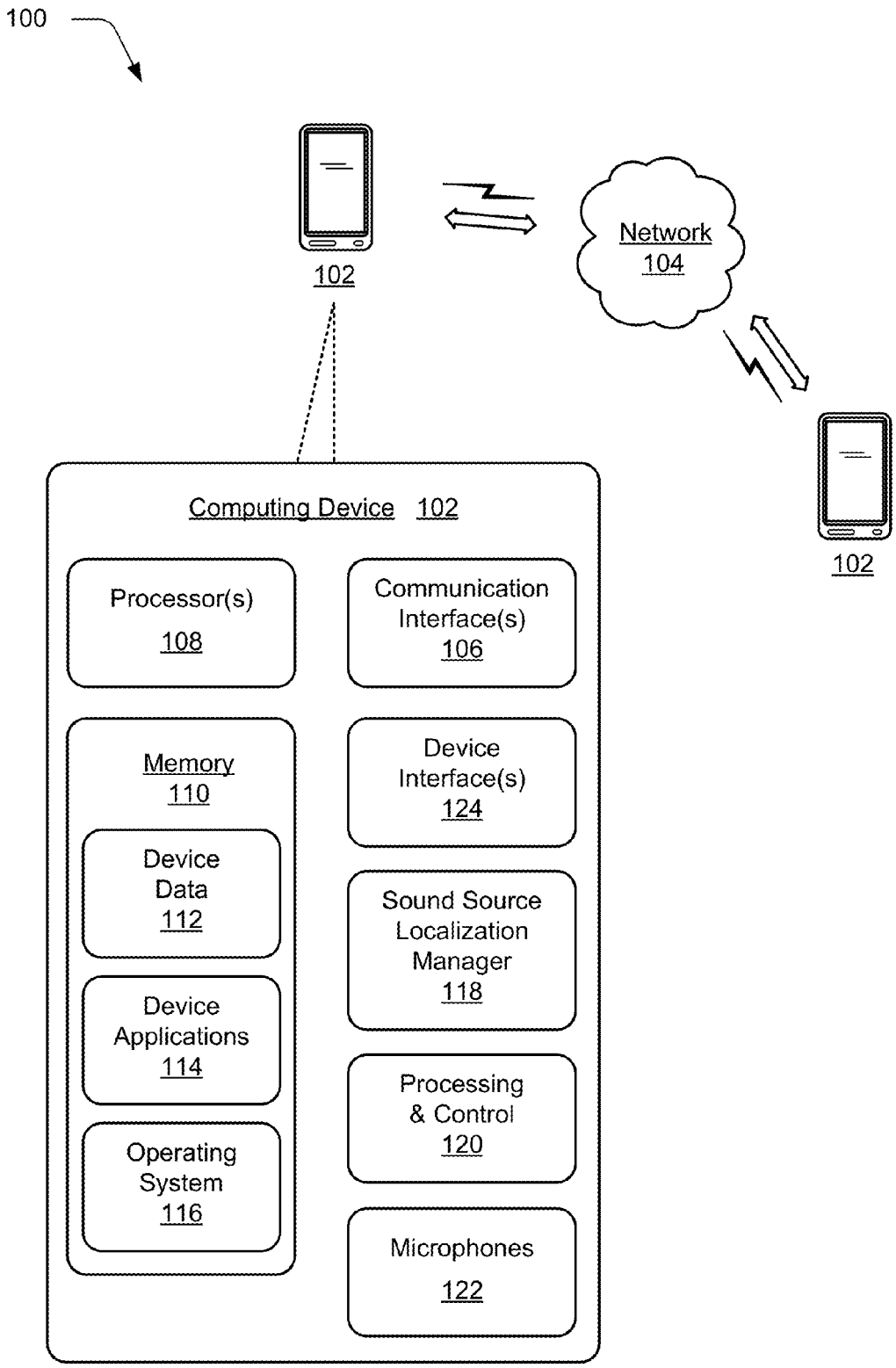
FIG. 1 illustrates an example environment in which aspects of concurrent sound source localization of multiple speakers can be implemented.

FIG. 1 illustrates an example system 100 in which aspects of concurrent sound source localization of multiple speakers can be implemented. The example system includes a computing device 102 which may be connected to another computing device 102 through a network 104 using a communication interface 106. The connection between the computing devices 102 may be for the purpose of audio and/or video communication between users of the computing devices 102, such as voice calling, Voice over IP (VoIP), audio and/or video conference calling, and so forth.

The network 104 can be implemented using any type of network topology and/or communication protocol, and can be represented or otherwise implemented as a combination of two or more networks, to include IP-based networks and/or the Internet. The network 104 may also include mobile operator networks that are managed by mobile operators, such as a communication service provider, cellphone provider, and/or Internet service provider.

The example system includes the computing devices 102, which may be any one or combination of mobile computing or communication devices, such as a mobile phone, tablet device, computing device, communication, entertainment, gaming, navigation, and/or other type of wired or portable electronic device. The computing devices 102 are generally implemented with a network interface for data communication with network-connected devices via a network. Any of the computing devices 102 may communicate with another computing device 102 over the network 104. Additionally, any of the computing devices 102 can be implemented with various components, such as a processor and/or memory system, as well as any number and combination of differing components.

The computing device 102 also includes one or more processors 108 (e.g., any of microprocessors, controllers, and the like), and memory 110, such as any type of random access memory (RAM), a low-latency nonvolatile memory such as flash memory, read only memory (ROM), and/or other suitable electronic data storage.

A memory 110 provides data storage mechanisms to store the device data 112, other types of information and/or data, and device applications 114. For example, an operating system 116 can be maintained as a software application with the memory device and executed on the processors. The device applications may also include a device manager or controller, such as any form of an audio and/or video communication application, control application, software application, signal processing and control module, code that is native to a particular device, a hardware abstraction layer for a particular device, and so on.

Computing device 102 also includes a sound source localization manager 118, which implements embodiments of concurrent sound source localization of multiple speakers. In an implementation, the sound source localization manager 118 may be any one or combination of hardware, firmware, or fixed logic circuitry that is implemented in connection with processing and control circuits, which are generally identified at 120. Alternatively and/or in addition, the sound source localization manager 118 may be implemented at computing device 102 as computer-executable instructions maintained by memory 110 and executed by processors 108 to implement various embodiments and/or features of concurrent sound source localization of multiple speakers.

Computing device 102 also includes microphones 122 which receive sounds from users of the computing device 102 as well as sounds from the environment around the computing device 102. The output of the microphones 122 are audio signals that are connected to the sound source localization manager 118 through a device interface 124, which may include amplifiers, attenuators, signal conditioning, analog to digital converters (ADCs), and the like.

Figure 2:
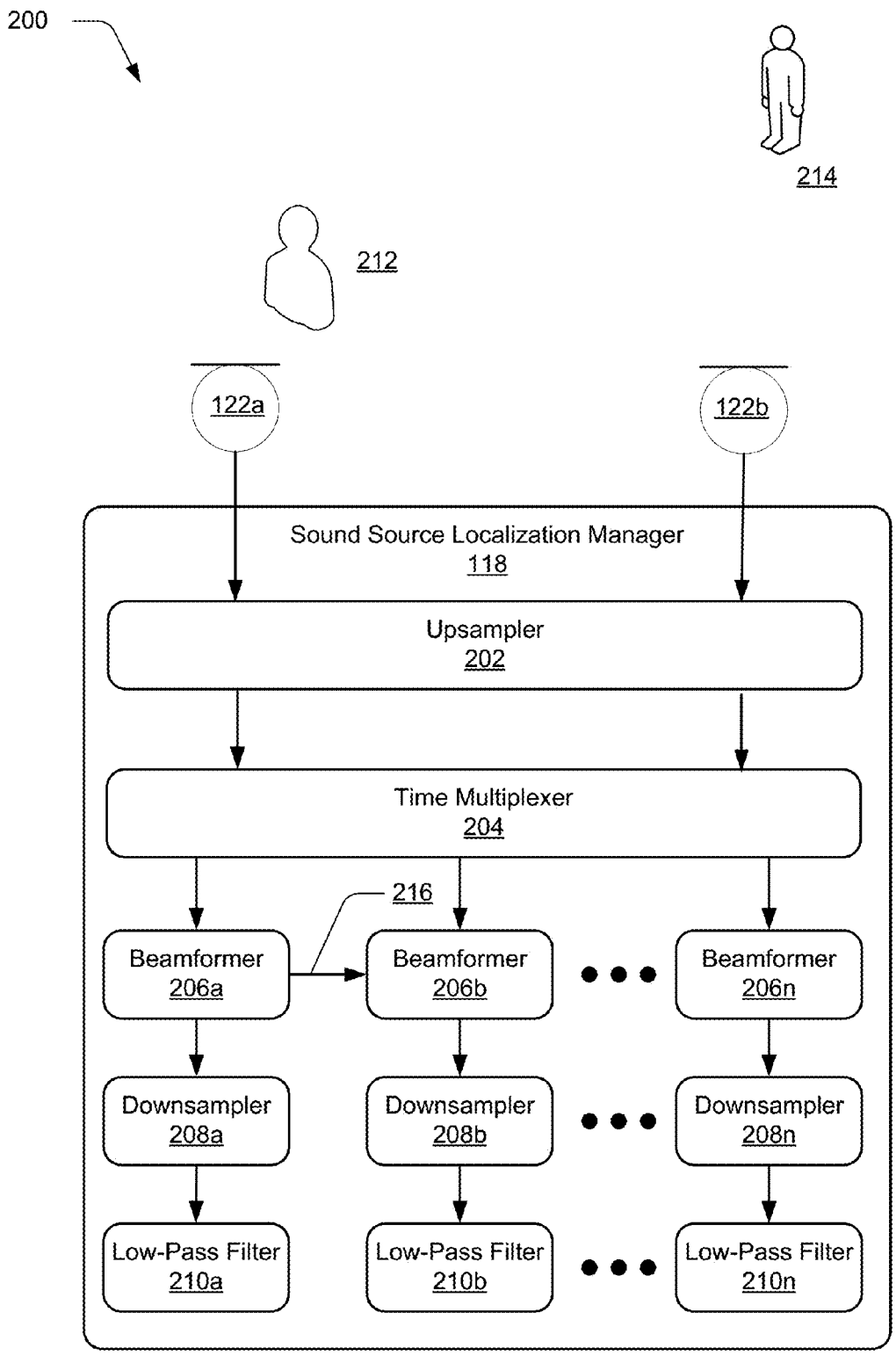
FIG. 2 illustrates various components of a sound source localization manager that can implement aspects of concurrent sound source localization of multiple speakers.

FIG. 2 illustrates an example embodiment of the sound source localization manager 118, which includes an upsampler 202, a time multiplexer 204, beamformers 206 (illustrated as 206*a*, 206*b* . . . 206*n* to show that a variable number of beamformers may be used), downsamplers 208 (illustrated as 208*a*, 208*b*, . . . 208*n*), and low-pass filters 210 (illustrated as 210*a*, 210*b*, . . . 210*n*). Although two microphones 122 are illustrated, at 122*a* and 122*b* in FIG. 2, any suitable number of microphones may be used.

In an example, a communication application is executing on the computing device 102 for a conference call. The computing device 102 is configured to be used as a speakerphone for multiple people in the vicinity of the computing device 102 during the conference call. One person on the conference call may be a dominant speaker by virtue of being closer to the microphones 122, such as at 212, and/or louder than other people, such as a person who is farther away and/or quieter, such as at 214.

Additionally, in the example, there may be sound sources (noise sources) in the environment that are undesirable during the conference call, such as air conditioning, computer, and/or projector fans, and so forth. Also reverberation and echoes in a conference room of the sound of a speaker's voice reflecting off surfaces with low sound absorption is undesirable and can reduce intelligibility of the speaker in the conference call.

The microphones 122 are connected to the upsampler 202 and the sounds received by the microphones 122 are provided as audio signals to the upsampler 202. The audio signals from each of the microphones 122 are converted from analog to digital, which may be converted by an ADC (not shown) at an initial sample rate before being provided to the upsampler 202.

The upsampler 202 upsamples the audio signals from the initial sample rate to a sample rate that is N-times greater than the initial sample rate, where N is an integer and equal to the number of beamformers 206. The value of N is also the number of sound sources that are concurrently localized. The upsampling produces N-times the number of samples of the audio signals than the number of samples produced at the initial sample rate. The time multiplexer 204 routes the samples of the upsampled audio signals from the upsampler 202 to the beamformers 206.

Figure 3:
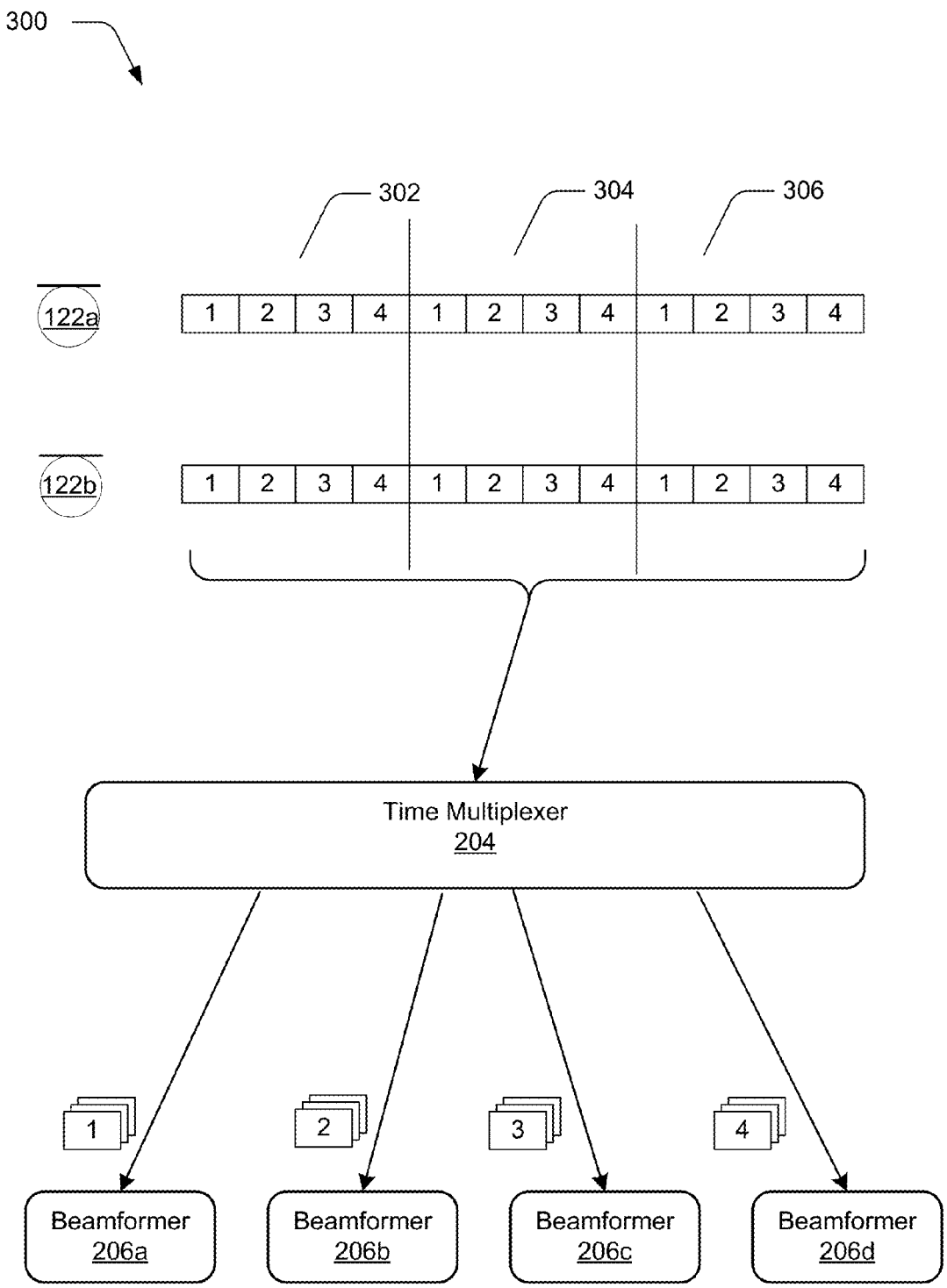
FIG. 3 illustrates example operations of time-multiplexing of concurrent sound source localization of multiple speakers in accordance with one or more aspects.

FIG. 3 illustrates an example where, for N=4, the upsampled audio signals from the two microphones, 122*a* and 122*b*, are time-multiplexed to four beamformers 206*a*-206*d*. Audio signals for three periods at the initial sample rate are shown at 302, 304, and 306. Upsampling with N=4 results in four times the number of samples in the upsampled audio signals compared to the number of samples from the initial rate sampling.

Continuing with the example, a different 1/N portion of the samples in the upsampled audio signals for each period is routed to each of the N-beamformers 206, so that each of the beamformers 206 is processing a different set of samples than the other beamformers 206. The labeled blocks in each period (302, 304, and 306) illustrate which portions of the upsampled audio signals are sent to each beamformer 206. The blocks labeled "1" in FIG. 3 are multiplexed by the time multiplexer 204 to the first beamformer 206*a*, the blocks labeled "2" are multiplexed to the second beamformer 206*b*, and so forth. In general terms, for any N, the samples 1, N+1, 2N+1, 3N+1, . . . of each upsampled audio signal are multiplexed to the first beamformer 206, the samples 2, N+2, 2N+2, 3N+2, . . . of each upsampled audio signal are multiplexed to the second beamformer 206, and so forth.

Returning to the example of FIG. 2, the beamformers 206 determine the locations of sound sources in the environment of the computing device 102, with respect to the microphones 122. In an example embodiment each beamformer 206 determines the location of a sound source in terms of the distance to the sound source, a lateral or azimuth angle to the sound source, and an elevation angle to the sound source, expressed as beamforming coefficients ($r$, $\theta$, $\phi$). Without placing any constraints on each of the beamformers 206, each beamformer would converge to the same, dominant sound source.

In order to concurrently localize multiple sound sources, each successive beamformer 206 is constrained by the results of each proceeding beamformer 206. For example the beamformer 206*a* determines the location of the most dominant sound source ($r_1$, $\theta_1$, $\phi_1$). The beamformer 206*a* communicates the result ($r_1$, $\theta_1$, $\phi_1$) to the second beamformer 206*b*, as shown at 216. These results may be communicated between the beamformers 206 in any suitable manner such as a serial bus, a parallel bus, via storage registers, and the like.

The second beamformer 206*b* is constrained by the result of beamformer 206*a* to prevent the second beamformer 206*b* from converging on the location ($r_1$, $\theta_1$, $\phi_1$). The location ($r_1$, $\theta_1$, $\phi_1$) is used by the second beamformer 206*b* to determine the location of the second most dominate sound source ($r_2$, $\theta_2$, $\phi_2$), which is constrained to not be ($r_1$, $\theta_1$, $\phi_1$). In turn, the third beamformer 206*c* determines the location of the third most dominate sound source ($r_3$, $\theta_3$, $\phi_3$) using ($r_1$, $\theta_1$, $\phi_1$) and ($r_2$, $\theta_2$, $\phi_2$) as constraints, and so forth for the remaining beamformers 206.

The beamformers 206 may utilize any of the techniques that are well known in the art to localize the sound sources and determine the beamforming coefficients. For example, the beamformers can perform correlations on the delay between signals reaching the microphones 122 to converge on the beamforming coefficients that correspond to the most dominant sound.

Each of the beamformers 206 filters the upsampled audio signals using the determined beamformer coefficients to produce a beamformed audio signal. The beamformed audio signal is downsampled by a corresponding downsampler 208 and low-pass filtered by a corresponding low-pass filter 210. The downsamplers 208 downsample the corresponding beamformed audio signal to the initial sample rate. The beamformed audio signals, after downsampling and low-pass filtering, are provided to other hardware or software components of the computing device 102, such as for transmission to the far-end of an audio and/or video communication conducted using one of the device applications 114.

Figure 4:
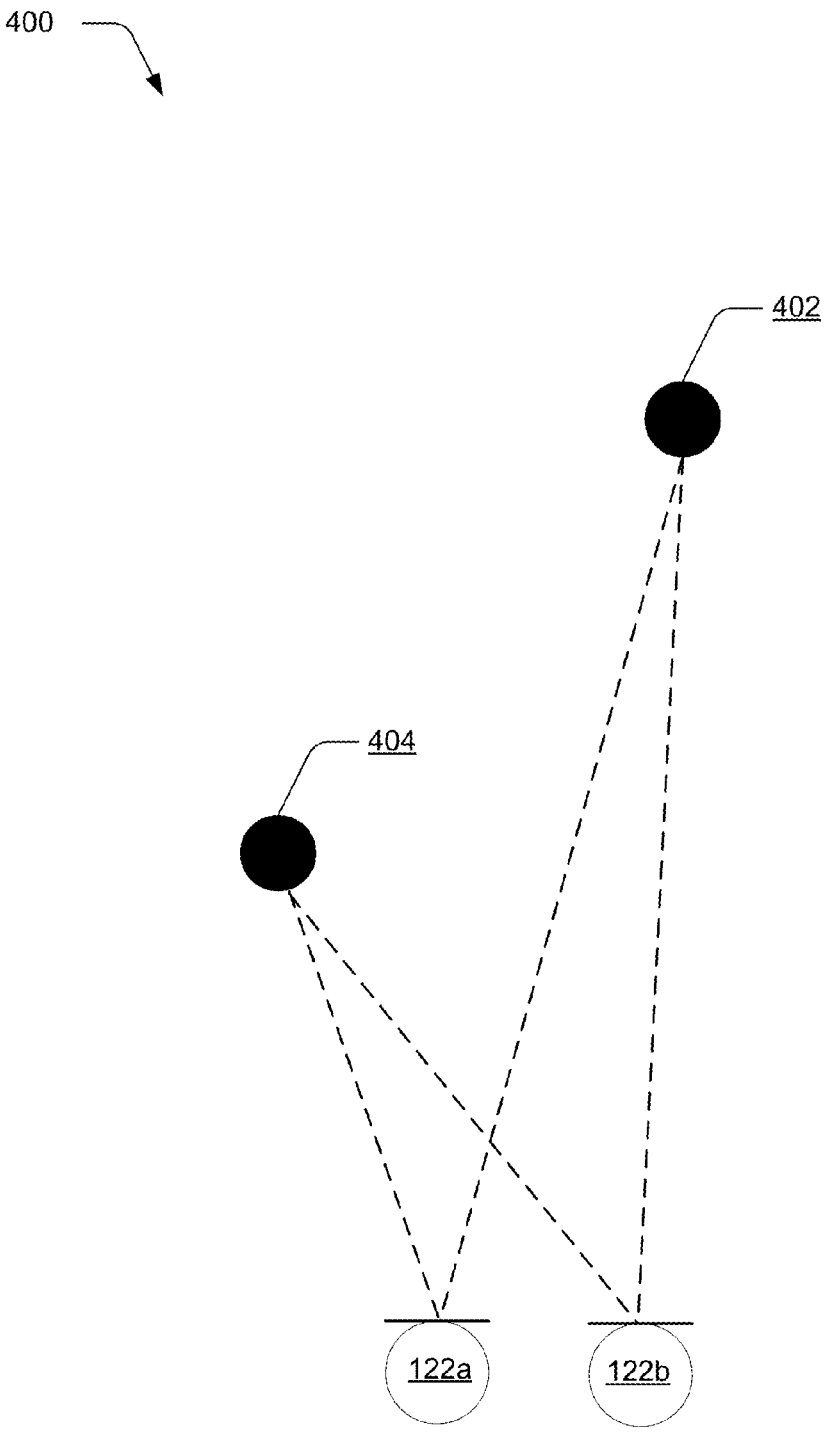
FIG. 4 illustrates an example application of concurrent sound source localization of multiple speakers in accordance with one or more aspects.

FIG. 4 illustrates an example of the sound source localization manager 118 that concurrently localizes multiple speakers 402 and 404 in a conference call. In a conventional system that beamforms for a single sound source, there is a time delay while the beamformer locates a new sound source, such as when the speaker 402 stops talking and the speaker 404 starts talking in the conference call. During the time delay of this transition, the beamformer is not focused on either speaker 402 or 404, and the quality of the audio in the conference call suffers during this transition.

However in the techniques described herein, the sound source localization manager 118 localizes multiple sources received at the microphones 122, as illustrated by the dashed lines in FIG. 4, including from the speaker 402 and the speaker 404. The sound source localization manager 118 concurrently provides beamformed audio for the speakers 402 and 404, eliminating the transition time delay.

Figure 5:
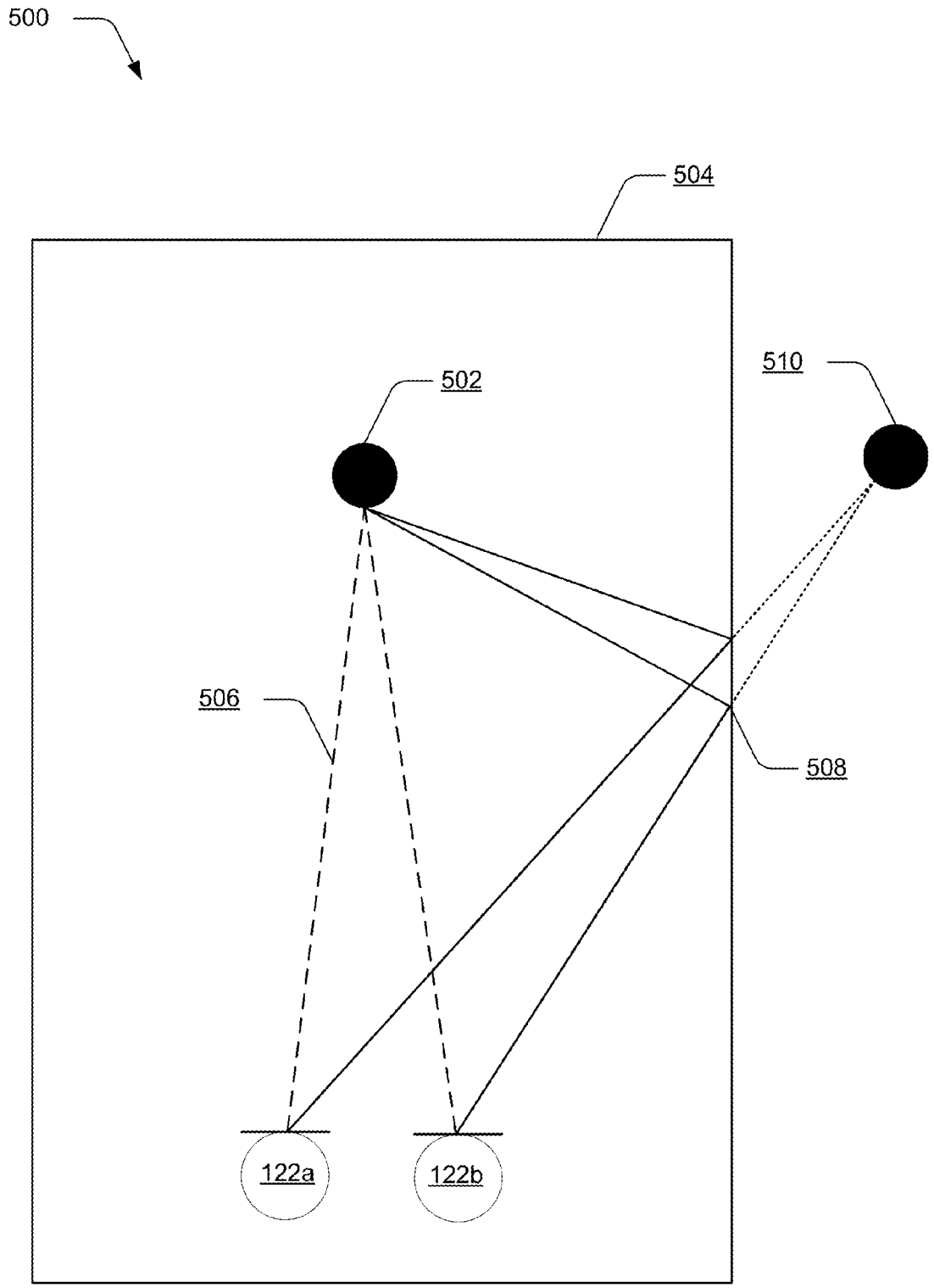
FIG. 5 illustrates an example application of concurrent sound source localization of multiple speakers in accordance with one or more aspects.

FIG. 5 illustrates an example of the sound source localization manager 118 that localizes multiple sound sources to cancel echoes and reverberation. A speaker 502 emits audio using the computing device 102 (for clarity, illustrated by the microphones 122 in FIG. 5) in a room 504. Sound from the speaker 502 is received directly at the microphones 122, as shown by the dashed lines at 506. Reflected sound from the speaker 502 is also received at the microphones 122 after reflecting off a wall of the room 504 as shown by the solid lines at 508.

The sound source localization manager 118 localizes the reflected sound as a phantom sound source 510. The sound source localization manager 118 concurrently localizes the sound of the speaker 502 and the reflection of the speaker's sound (the phantom sound source 510) as shown by the dotted lines in FIG. 5. The audio signal corresponding to the localized phantom sound source 510 is used to cancel the echo from the reflected sound in the audio that is transmitted from the communication device 102.

The sound source localization manager 118 can be configured to concurrently localize multiple reflections in the same manner using multiple beamformers 206 to mitigate the reverberation from multiple echoes in a highly reverberant environment. As an example, and not by way of limitation, configuring the sound source localization manager 118 with N=7 (seven beamformers 206) provides sufficient cancellation to de-reverberate a reflective MOM.

Figure 6:
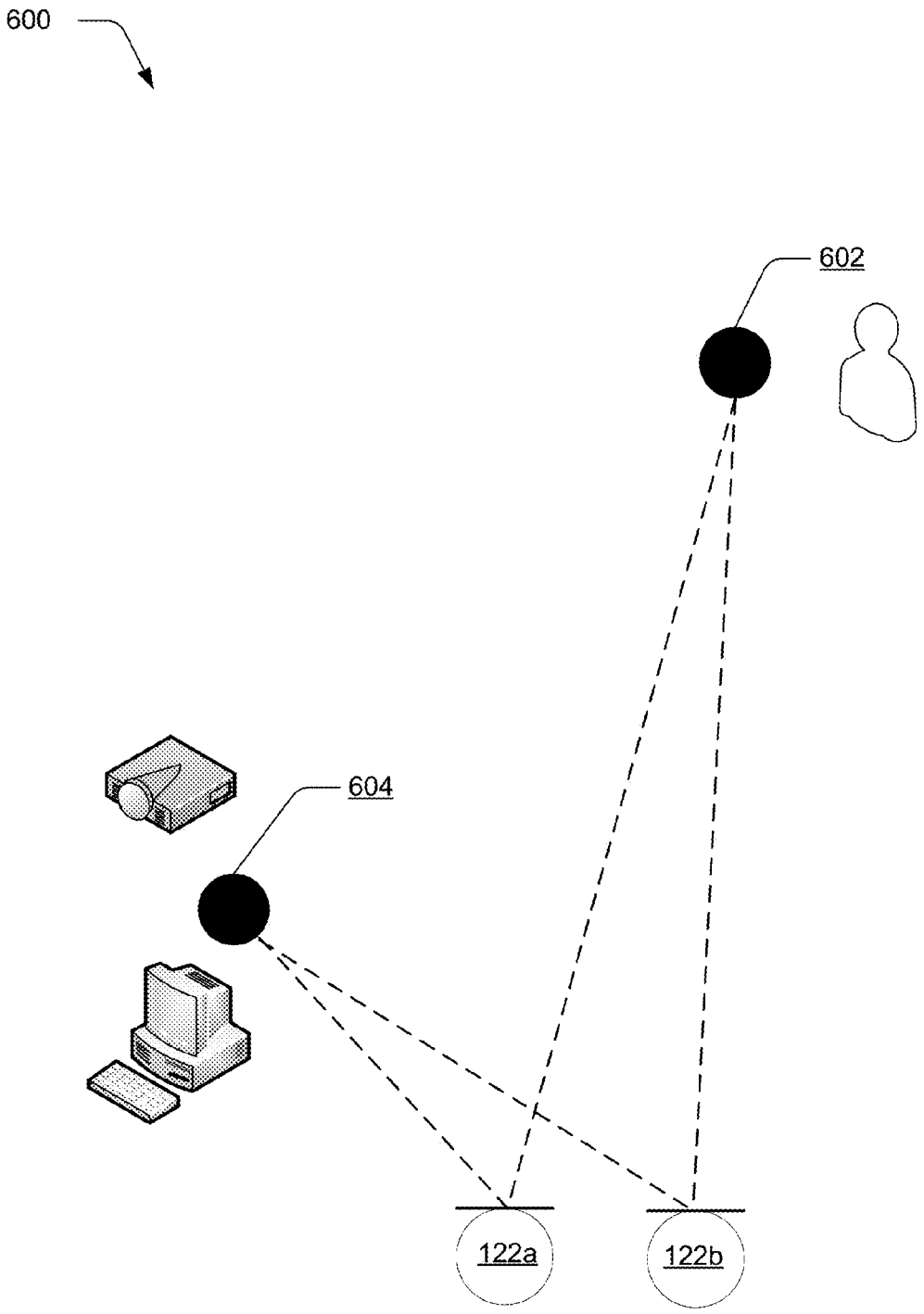
FIG. 6 illustrates an example application of concurrent sound source localization of multiple speakers in accordance with one or more aspects.

FIG. 6 illustrates another example of the sound source localization manager 118 that concurrently localizes multiple sound sources to localize background noise sources for noise cancellation. Often in background noise there are a few primary noise sources that are the most significant contributors to the background noise, such as a computer fan or a projector fan in a conference room, a television in a living room, street noise from an open window, and so forth. A desired sound source is shown at 602 and an unwanted noise source is shown at 604. By concurrently localizing and tracking the desired source 602 and the noise source 604, the beamformed audio signal from localizing the noise source 604 is used to cancel the background noise from the noise source 604, using one of the techniques of noise cancellation that are well known in the art. Multiple noise sources may be tracked to further reduce background noise.

It should be noted that in these examples, the computing device 102 may be in a fixed location or may be moving, such as when the computing device 102 is a mobile communication device. By concurrently localizing multiple sound sources, the sound source localization manager 118 tracks the location of multiple sound sources that are in motion in relation to each other and the computing device 102. By way of example, the background noise of a television in a living room can be canceled as a user walks around the room talking using a cellular phone, or the sound of a passing vehicle can be canceled while the user walks down a street talking on the cellular phone.

Example method 700 is described with reference to respective FIGS. 1-6 in accordance with one or more aspects of concurrent sound source localization of multiple speakers. Generally, any of the services, functions, methods, procedures, components, and modules described herein can be implemented using software, firmware, hardware (e.g., fixed logic circuitry), manual processing, or any combination thereof. A software implementation represents program code that performs specified tasks when executed by a computer processor. The example methods may be described in the general context of computer-executable instructions, which can include software, applications, routines, programs, objects, components, data structures, procedures, modules, functions, and the like. The program code can be stored in one or more computer-readable storage media devices, both local and/or remote to a computer processor. The methods may also be practiced in a distributed computing environment by multiple computer devices. Further, the features described herein are platform-independent and can be implemented on a variety of computing platforms having a variety of processors.

Figure 7:
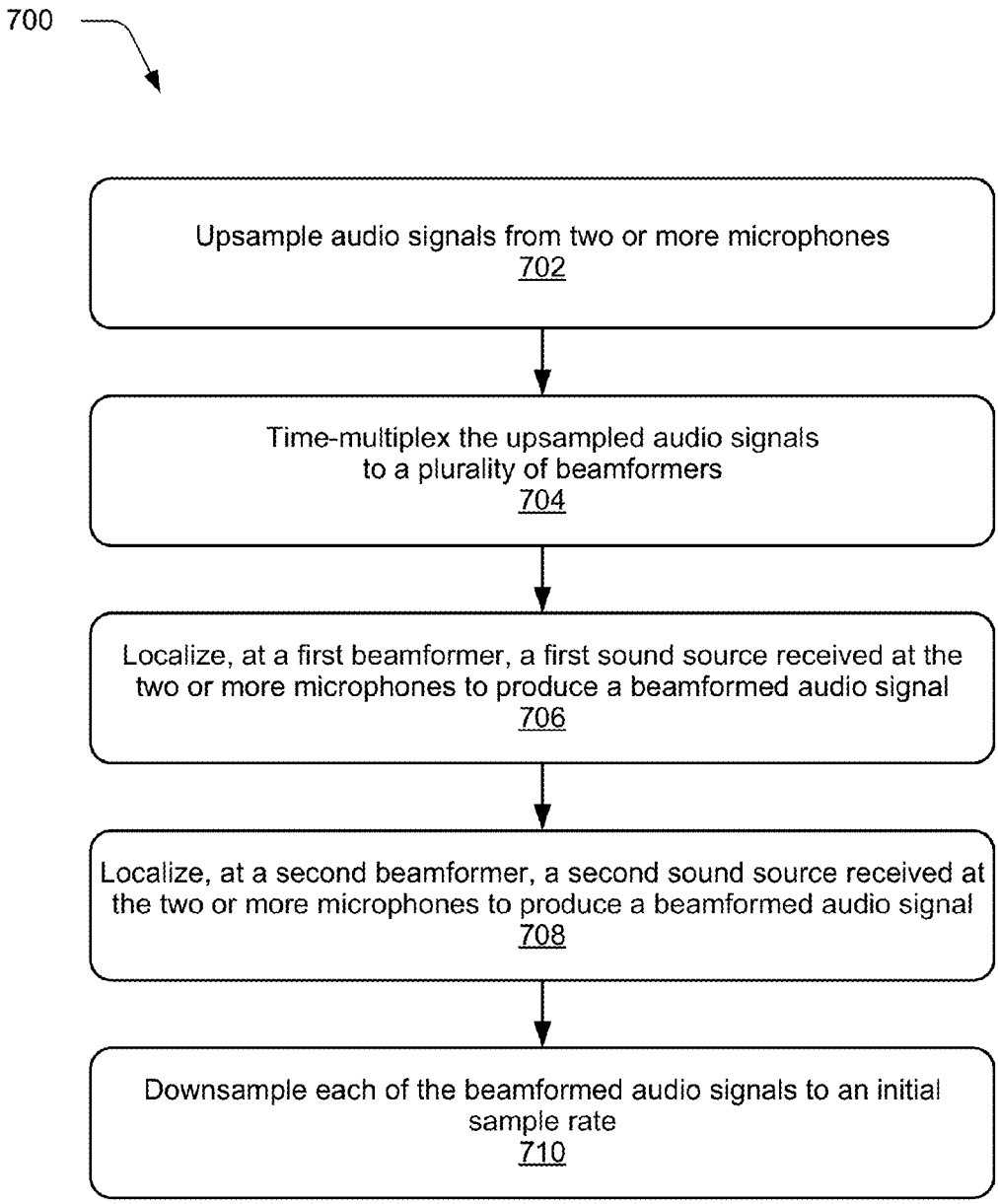
FIG. 7 illustrates example methods of a configurable print server device in accordance with one or more aspects.

FIG. 7 illustrates example method 700 of concurrent sound source localization of multiple speakers, and is described with reference to the computing device 102 and the sound source localization manager 118. The order in which the method is described is not intended to be construed as a limitation, and any number of the described method operations can be combined in any order to implement the method, or an alternate method.

At 702, audio signals from two or more microphones are upsampled. For example, the upsampler 202 upsamples the audio signals from the two or more microphones 122.

At 704, the upsampled audio signals are time-multiplexed to a plurality of beamformers. For example, the time-multiplexer 204 time multiplexes the upsampled audio signals from the upsampler 202 to the beamformers 206.

At 706, a first sound source is localized by a first beamformer. For example, the beamformer **206*a* localizes a first sound source and determines beamforming coefficients for the first sound source. The beamformer 206*a*** filters the upsampled audio signal to produce a beamformed audio output for the first sound source.

At 708, a second sound source is localized by a second beamformer. For example, the beamformer **206*b* localizes a second sound source by using the beamforming coefficients produced by the beamformer 206*a* as a constraint to localize the second sound source. The beamformer 206*b* determines beamforming coefficients for the second sound source. The beamformer 206*b*** filters the upsampled audio signal to produce a beamformed audio output for the second sound source.

At 710, the beamformed audio sources are downsampled to an initial sample rate. For example, the downsamplers 208 downsample the beamformed audio signals from respective beamformers 206.

Figure 8:
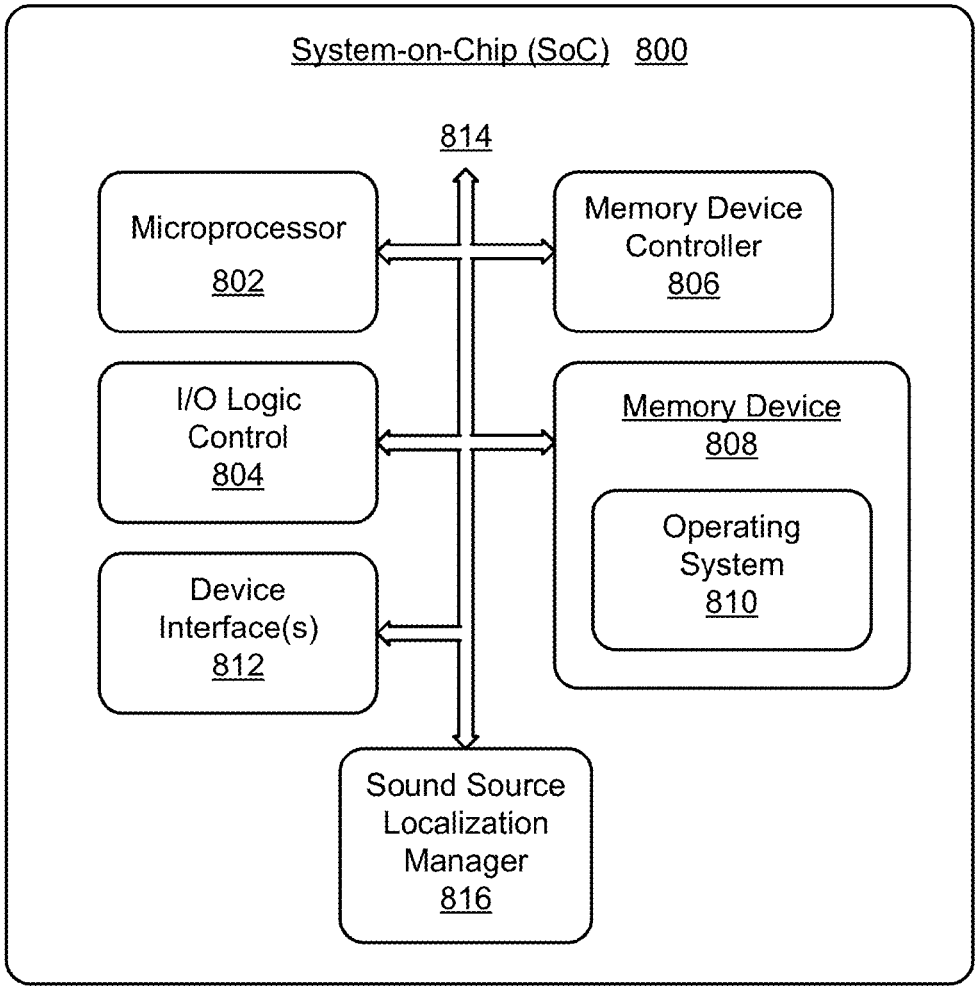
FIG. 8 illustrates an example system-on-chip (SoC) environment in which aspects of concurrent sound source localization of multiple speakers can be implemented.

FIG. 8 illustrates an example system-on-chip (SoC) 800, which can implement various aspects of a concurrent sound source localization of multiple speakers as described herein. The SoC may be implemented in any type of computing device, such as the computing device 102 described with reference to FIG. 1. The SoC 800 can be integrated with electronic circuitry, a microprocessor, memory, input-output (I/O) logic control, communication interfaces and components, as well as other hardware, firmware, and/or software to implement the sound source localization manager 118.

In this example, the SoC 800 is integrated with a microprocessor 802 (e.g., any of a microcontroller or digital signal processor) and input-output (I/O) logic control 804 (e.g., to include electronic circuitry). The SoC 800 includes a memory device controller 806 and a memory device 808, such as any type of a nonvolatile memory and/or other suitable electronic data storage device. The SoC can also include various firmware and/or software, such as an operating system 810 that is maintained by the memory and executed by the microprocessor.

The SoC 800 includes a device interface 812 to interface with a device or other peripheral component, such as when installed in the computing device 102 as described herein. The SoC 800 also includes an integrated data bus 814 that couples the various components of the SoC for data communication between the components. The data bus in the SoC may also be implemented as any one or a combination of different bus structures and/or bus architectures.

In aspects of a concurrent sound source localization of multiple speakers, the SoC 800 includes a sound source localization manager 816 that can be implemented as computer-executable instructions maintained by the memory device 808 and executed by the microprocessor 802. Alternatively, the sound source localization manager 816 can be implemented as hardware, in firmware, fixed logic circuitry, or any combination thereof that is implemented in connection with the I/O logic control 804 and/or other processing and control circuits of the SoC 800. Examples of the sound source localization manager 816, as well as corresponding functionality and features, are described with reference to the sound source localization manager 118, shown in FIG. 2 and described with reference to FIGS. 1-7.

Although aspects of a concurrent sound source localization of multiple speakers have been described in language specific to features and/or methods, the subject of the appended claims is not necessarily limited to the specific features or methods described. Rather the specific features and methods are disclosed as example implementations of a concurrent sound source localization of multiple speakers, and other equivalent features and methods are intended to be within the scope of the appended claims. Further, various different aspects are described and it is to be appreciated that each described aspect can be implemented independently or in connection with one or more other described aspects.

What is claimed is:

1. A method of localizing multiple sound sources, comprising:

upsampling audio signals from two or more microphones;

time-multiplexing the upsampled audio signals to a plurality of beamformers;

localizing, at a first beamformer of the plurality of beamformers, a first sound source received at the two or more microphones; and localizing, at a second beamformer of the plurality of beamformers, a second sound source received at the two or more microphones, said localizing the second sound source is constrained by said localizing the first sound source.

2. The method as recited in claim 1, wherein the localizing the first sound source and the localizing the second sound source comprises determining beamforming coefficients for the respective sound sources, the method further comprising:

filtering each of the upsampled audio signals, using the determined beamforming coefficients, at each beamformer of the plurality of the beamformers to produce a corresponding beamformed audio signal; and downsampling each of the beamformed audio signals to an initial sample rate.

3. The method as recited in claim 1, further comprising:

sampling an output of each of the two or more microphones at an initial sample rate to produce the audio signals, wherein an upsampling rate is an integer-multiple of the initial sample rate, and the number of beamformers in the plurality of beamformers equals the integer-multiple.

4. The method as recited in claim 1, wherein the constraint on said localizing the second sound source comprises determined beamforming coefficients for the first sound source, and wherein the constraint prevents the second beamformer from localizing the first sound source.

5. The method as recited in claim 1, further comprising:

localizing, at a third beamformer of the plurality of beamformers, a third sound source received at the two or more microphones, said localizing the third sound source is constrained by said localizing the first sound source and said localizing the second sound source.

6. The method as recited in claim 1, wherein the first sound source corresponds to a most dominant sound received at the two or more microphones, and the second sound source corresponds to a second most dominant sound received at the two or more microphones.

7. The method as recited in claim 1, wherein the first sound source and the second sound source are localized concurrently.

8. A device, comprising:

a hardware upsampler to upsample audio signals received from two or more microphones;

a hardware time-multiplexer to distribute the upsampled audio signals to a plurality of beamformers; and the plurality of beamformers being configured to:

localize, at a first beamformer of the plurality of beamformers, a first sound source received at the two or more microphones; and localize, at a second beamformer of the plurality of beamformers, a second sound source received at the two or more microphones, the localization of the second sound source constrained by the localization of the first sound source.

9. The device as recited in claim 8, wherein the localization of the first sound source and the localization of the second sound source comprise determining beamforming coefficients for the respective sound sources, each beamformer of the plurality of beamformers is further configured to:

filter the upsampled audio signal, distributed to the beamformer, using the determined beamforming coefficients to produce a beamformed audio signal.

10. The device as recited in claim 9, wherein a constraint on the localization of the second sound source comprises the beamforming coefficient for the first sound source, and wherein the constraint prevents the second beamformer from localizing the first sound source.

11. The device as recited in claim 8, further comprising:

downsamplers that are each associated with a respective one of the plurality of the beamformers, wherein each of the downsamplers is configured to downsample a beamformed audio signal of the respective one of the beamformers to an initial sample rate.

12. The device as recited in claim 8, further comprising:

two or more samplers configured to sample an output of a respective one of the two or more microphones at an initial sample rate to produce the audio signals, wherein an upsampling rate is an integer-multiple of the initial sample rate, and the number of beamformers in the plurality of beamformers equals the integer-multiple.

13. The device as recited in claim 8, wherein the plurality of beamformers are further configured to:

localize at a third beamformer of the plurality of beamformers, a third sound source received at the two or more microphones, the localization of the third sound source constrained by the localization of the first sound source and the localization of the second sound source.

14. The device as recited in claim 8, wherein the first sound source and the second sound source are localized concurrently.

15. The device as recited in claim 8, wherein the first sound source corresponds to a most dominant sound received at the two or more microphones, and the second sound source corresponds to a second most dominant sound received at the two or more microphones.

16. A sound source localization system, comprising:

an interface to receive signals of sound sources from two or more microphones;

two or more samplers to sample the received signals from the two or more microphones and produce corresponding sampled audio signals; and a processor and memory system to implement a sound source localization manager, the sound source localization manager configured to:

upsample the sampled audio signals;

time-multiplex the upsampled audio signals to a plurality of beamformers;

localize, at a first beamformer of the plurality of beamformers, a first sound source received at the two or more microphones; and localize, at a second beamformer of the plurality of beamformers, a second sound source received at the two or more microphones, the localization of the second sound source is constrained by the localization of the first sound source.

17. The sound source localization system as recited in claim 16, wherein the localization of the first sound source and the localization of the second sound source comprises the sound source localization manager configured to:

determine beamforming coefficients for the respective sound sources;

filter, at each beamformer, the upsampled audio signal using the determined beamforming coefficients to produce a corresponding beamformed audio signal; and downsample each of the beamformed audio signals to an initial sample rate.

18. The sound source localization system as recited in claim 16, wherein an up sampling rate is an integer-multiple of an initial sample rate and the number of beamformers in the plurality of beamformers equals the integer-multiple.

19. The sound source localization system as recited in claim 16, wherein the first sound source and the second sound source are localized concurrently.

20. The sound source localization system as recited in claim 16, wherein the system is implemented as a System-on-Chip (SoC) in a computing device.

* * * * *